US005985813A

United States Patent [19]

Arvanitidou

[11] Patent Number: 5,985,813

[45] Date of Patent: Nov. 16, 1999

[54] LIQUID CLEANING COMPOSITIONS BASED ON CATIONIC SURFACTANT, NONIONIC SURFACTANT AND NONIONIC POLYMER

[75] Inventor: Evangelia Arvanitidou, Kendall Park, N.J.

[73] Assignee: Colgate-Palmolive Co., Piscataway, N.J.

[21] Appl. No.: 09/287,722

[22] Filed: Apr. 7, 1999

[51] Int. Cl.[6] ..... C11D 1/72; C11D 1/62; C11D 1/75

[52] U.S. Cl. ..... 510/237; 510/235; 510/365; 510/421; 510/422; 510/423; 510/433; 510/475; 510/503; 510/504

[58] Field of Search ..... 510/365, 237, 510/235, 423, 421, 422, 433, 475, 503, 504

[56] References Cited

U.S. PATENT DOCUMENTS

| | | | |
|---|---|---|---|
| 3,337,463 | 8/1967 | Schmolka | 510/423 |
| 3,959,157 | 5/1976 | Inamorato | 510/329 |
| 4,065,409 | 12/1977 | Flanagan | 510/423 |
| 4,154,706 | 5/1979 | Kenkare et al. | 510/123 |
| 4,174,304 | 11/1979 | Flanagan | 510/182 |
| 4,203,872 | 5/1980 | Flanagan | 510/182 |
| 4,224,195 | 9/1980 | Kawasaki et al. | 8/137 |
| 4,233,167 | 11/1980 | Sramek | 510/325 |
| 4,264,479 | 4/1981 | Flanagan | 510/182 |
| 4,268,401 | 5/1981 | Meschkat et al. | 510/329 |
| 4,329,336 | 5/1982 | Su et al. | 424/70.17 |
| 4,335,024 | 6/1982 | Henneman et al. | 510/329 |
| 4,436,653 | 3/1984 | Jacobson et al. | 510/341 |
| 4,507,219 | 3/1985 | Hughes | 510/341 |
| 4,606,850 | 8/1986 | Malik | 510/420 |
| 4,842,771 | 6/1989 | Rorig et al. | 510/181 |
| 5,078,896 | 1/1992 | Rorig et al. | 510/372 |
| 5,476,615 | 12/1995 | Hall et al. | 510/384 |
| 5,573,710 | 11/1996 | McDonnell | 510/405 |
| 5,798,329 | 8/1998 | Taylor et al. | 510/384 |
| 5,858,936 | 1/1999 | Tamura et al. | 510/131 |

*Primary Examiner*—Yogendra Gupta
*Assistant Examiner*—Charles Boyer
*Attorney, Agent, or Firm*—Richard E. Nanfeldt

[57] ABSTRACT

A light duty, liquid cleaning composition with good grease cleaning properties and mildness to the human skin comprising: a water soluble nonionic surfactant, a nonionic polymer, a cationic surfactant and an amine oxide.

5 Claims, No Drawings

LIQUID CLEANING COMPOSITIONS BASED ON CATIONIC SURFACTANT, NONIONIC SURFACTANT AND NONIONIC POLYMER

BACKGROUND OF THE INVENTION

The present invention relates to novel light duty liquid detergent compositions with high foaming properties and excellent grease cutting properties, containing a nonionic surfactant, a cationic surfactant and an amine oxide surfactant.

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monethanolamide foam stabilizer.

However, none of the above-cited patents discloses a high foaming, liquid detergent composition containing a nonionic surfactant, a cationic surfactant and an amine oxide surfactant, wherein the composition does not contain inorganic or organic builder salts, glycol ethers, anionic surfactants, a biquanide compound, zwitterionic surfactants, amine acid germacides, glucamide surfactants, mono- or di-alkanol amides, inorganic and polymeric thickeners, fatty acid monoglycerides, organic acids or 1-(4-chlorophenoxyl)-1-imidazol-1-yl-3,3dimethyl butan-2-one.

SUMMARY OF THE INVENTION

It has now been found that a high foaming liquid detergent can be formulated with a nonionic surfactant, a cationic surfactant and an amine oxide surfactant which has excellent grease cutting properties.

An object of this invention is to provide a novel, liquid detergent compositions containing a nonionic surfactant, a cationic surfactant and an amine oxide surfactant.

The present light duty liquid cleaning composition comprises approximately by weight:

(a) 1% to 10% of at least one cationic surfactant;

(b) 12% to 26% of an amine oxide surfactant;

(c) 10% to 24% of at least one nonionic surfactant formed from the condensation product of an alkanol and ethylene oxide;

(d) 0 to 5% of a nonionic polymer formed from the condensation product of ethylene oxide, propylene oxide and ethylenediamine; and (e) the balance being water, wherein the composition does not contain inorganic or organic builder salts, glycol ethers, anionic surfactants, a biquanide compound, zwitterionic surfactants, amine acid germacides, glucamide surfactants, mono- or di-alkanol amides, inorganic and polymeric thickeners, fatty acid monoglycerides, organic acids or 1-(4-chlorophenoxyl)-1-imidazol-1-yl-3,3dimethyl butan-2-one. Also excluded from the instant compounds are polyoxyalkylene glycol fatty esters, abrasives, silica, abrasive, clays, alkali metal carbonates or more than 3 wt. % of a fatty acid or its salt thereof.

DETAILED DESCRIPTION OF THE INVENTION

The present light duty liquid cleaning composition comprises approximately by weight:

(a) 1% to 10% of at least one cationic surfactant;

(b) 12% to 26% of an amine oxide surfactant;

(c) 10% to 24% of at least one nonionic surfactant formed from the condensation product of an alkanol and ethylene oxide;

(d) 0 to 5% of a nonionic polymer formed from the condensation product of ethylene oxide, propylene oxide and ethylenediamine; and (e) the balance being water, wherein the composition does not contain inorganic or organic builder salts, glycol ethers, anionic surfactants, a biquanide compound, zwitterionic surfactants, amine acid germacides, glucamide surfactants, mono- or di-alkanol amides, inorganic and polymeric thickeners, fatty acid monoglycerides, organic acids or 1-(4-chlorophenoxyl)-1-imidazol-1-yl-3,3dimethyl butan-2-one.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good o/w emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic surfactants are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic surfactants which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64. The nonionic surfactant constitutes about 10% to 24% by weight, more preferably about 12% to 20% by weight of the composition. The amine oxide surfactant comprises about 12% to 26% by weight, more preferably about 14% to 22% by weight of the composition.

The amine oxides are semi-polar nonionic surfactants which comprise compounds and mixtures of compounds having the formula

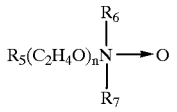

wherein $R_5$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_6$ and $R_7$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

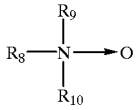

wherein $R_8$ is a $C_{12-16}$ alkyl group or amido radical:

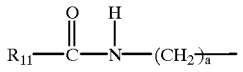

wherein $R_{11}$ is an alkyl group having about 9 to 19 carbon atoms and a is an integer 1 to 4 and $R_9$ and $R_{10}$ are methyl or ethyl. The above ethylene oxide condensates, amides, and amine oxides are more fully described in U.S. Pat. No. 4,316,824 which is hereby incorporated herein by reference. An especially preferred amine oxide is cocoamido propyl dimethyl amine oxide.

The nonionic block polymer constitutes about 0 to 5% by weight, more preferably 0.1% to 4% by weight of a composition. The nonionic polymer is formed from the condensation product of ethylene diamine, ethylene oxide and propylene oxide. The nonionic polymer is depicted by the formula selected from the group consisting of:

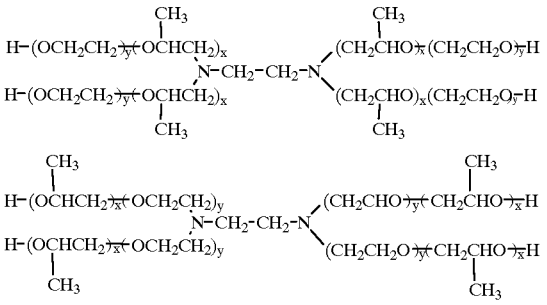

wherein x and y are numbers such that the average molecular weight of the nonionic block polymer is about 3,600 to about 30,000. These nonionic polymers are manufactured and sold under the tradename Tetronic™. Especially preferred are Tetronic 704 having an average molecular weight of 5,500 and Tetronic 1307 having an average molecular weight of 18,000.

The cationic surfactant which constitutes about 1% to 10% by weight, more preferably 2% to 8% by weight of the composition is depicted by the formula:

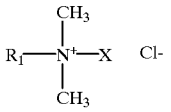

wherein $R_1$ is a $C_8$–$C_{18}$ alkyl group and x is selected from the group consisting of a $C_8$–$C_{10}$ alkyl group and a benzyl group.

This particular combination of a cationic surfactant, a nonionic surfactant, an amine oxide and a nonionic polymer cleaning composition with good grease cutting properties produce a liquid with desirable foaming, foam stability, detersive properties and mildness to human skin. Surprisingly, the resultant homogeneous liquid detergent exhibits the same or better foam performance, both as to initial foam volume and stability of foam in the presence of soils, and cleaning efficacy.

The nonionic polymer and the cationic surfactant and the amine oxide are solubilized in the water. To the composition can also be added water soluble hydrotropic salts include sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from 1%–15%, preferably 2%–12%, most preferably 2%–8%, by weight of the cleaning composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to modify the cloud point of the nonionic surfactant and thereby control the haze of the resultant solution. Various other ingredients such as urea at a concentration of 0.5 to 4.0 wt. % or urea at the same concentration in combination with ethanol at a concentration of 0.5 to 4.0 wt. % can be used as solubilizing agents. Other ingredients which have been added to the compositions at concentrations of 0.1 to 4.0 wt. percent are perfumes, sodium bisulfite, sodium ETDA, isoethanoeic acid and proteins such as lexine protein. The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be a maximum of 5% by weight and preferably less than 2% by weight. Sodium formate can be included in the formula as a preservative at a concentration of 0.1 to 4.0%. Sodium bisulfite can be used as a color stabilizer at a concentration of 0.01 to 0.2 wt. %

The present light duty liquid detergents such as dishwashing liquids are readily made by simple mixing methods from readily available components which, on storage, do not adversely affect the entire composition. However, it is preferred that the nonionic surfactant be mixed with the solubilizing ingredients, e.g., ethanol and, if present, prior to the addition of the water to prevent possible gelation. The surfactant system is prepared by sequentially adding with agitation the cationic surfactant, the nonionic polymer and the amine oxide to the aqueous solution of the nonionic surfactant which has been previously mixed with a solubilizing agent such as ethyl alcohol and/or sodium xylene sulfonate to assist in solubilizing said surfactants, and then adding with agitation the formula amount of water to form an aqueous solution of the cleaning composition. The use of mild heating (up to 100° C.) assists in the solubilization of the surfactants. The viscosities are adjustable by changing the total percentage of active ingredients. In all such cases the product made will be pourable from a relatively narrow mouth bottle (1.5 cm. diameter) or opening, and the viscosity of the detergent formulation will not be so low as to be like water. The viscosity of the detergent desirably will be at least 100 centipoises (cps) at room temperature, but may be up to 1,000 centipoises as measured with a Brookfield Viscometer using a number 3 spindle rotating at 12 rpm. Its viscosity may approximate those of commercially acceptable detergents now on the market. The pH of this formation is substantially neutral to skin, e.g., 4.5 to 8 and preferably 5.0 to 5.0.

The following examples are merely illustrative of the invention and are not to be construed as limiting thereof.

DESCRIPTION OF THE PREFERRED EMBODIMENTS

EXAMPLE 1

The following formulas were prepared at room temperature by simple liquid mixing procedures as previously described

| | A (gr) | B (gr) | C (gr) |
|---|---|---|---|
| BTC 888 | 6.125 | 6.125 | 6.125 |
| Cocoamido propyl amine oxide | 18.7 | 18.7 | 18.7 |
| Neodol 91-6 | 15.175 | 15.175 | 15.175 |
| Na4EDTA | 0.25 | 0.25 | 0.25 |
| Tetronic 704 | 0 | 1 | 0 |
| Tetronic 1307 | 0 | 0 | 1 |
| Water | 159.75 | 58.75 | 158.75 |
| Cup test (% tallow removed) | 5% | 12% | 10% |

The cup test consists of solidifying about 6.5 g of beef tallow in the bottom of a tripour cup. Dish liquid solutions were heated to 115° F., then poured into the soiled cups and allowed to soak for 15 min. Cups were allowed to dry overnight and the final weight of the grease remaining was measured and used to calculate the % grease removed. The test concentration is 2.67 g/L for a dish liquid, or 1.2 g/L of surfactant. Three replicas were measured for each product. BCT 888 is a mixture of C14–C16 N-alkyl dimethyl benzyl ammonium chloride and C8–C10 dialkyl dimethyl ammonium chloride.

What is claimed is:

1. A light duty, liquid cleaning composition comprising approximately, by weight, (a) 10% to 24% of at least one water soluble nonionic surfactant selected from the group consisting of primary and secondary $C_8$–$C_{18}$ alkanol condensates with 5 to 30 moles of ethylene oxide, condensates of $C_8$–$C_{18}$ alkylphenol with 5 to 30 moles of ethylene oxide, condensates of $C_8$–$C_{20}$ alkanol with a heteric mixture of ethylene oxide and propylene oxide having a weight ratio of ethylene oxide to propylene oxide from 2.5:1 to 4:1 and a total alkylene oxide content of 60% to 85% by weight, and said surfactant having an HLB of 8 to 15;

(b) 1% to 10% of at least one cationic surfactant which is depicted by the fornula:

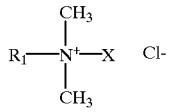

wherein $R_1$ is a $C_8$–$C_{18}$ alkyl group and x is selected from the group consisting of a $C_8$–$C_{10}$ alkyl group and a benzyl group;

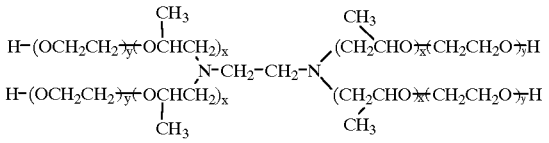

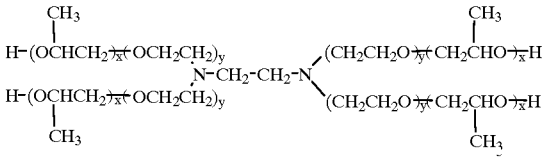

wherein x and y are numbers such that the average molecular weight of about 3,600 to about 30,000;

(d) 12% to 26% of a water soluble amine oxide; and (e) the balance being water.

2. A cleaning composition according to claim 1 which includes, in addition, 1% to 15% by weight of a solubilizing agent which is a water soluble salt of sodium xylene sulfonate or sodium cumene sulfonate, wherein the proportion of ethanol is less than 5 wt. %.

3. A liquid detergent composition according to claim 2 wherein said nonionic surfactant is a condensate of a primary $C_8$–$C_{18}$ alkanol with 5–30 moles of ethylene oxide.

4. A cleaning composition according to claim 1 further including a perservative.

5. A cleaning composition according to claim 1 further including a color stabilizer.

* * * * *